US008015950B2

(12) United States Patent
Okamoto et al.

(10) Patent No.: US 8,015,950 B2
(45) Date of Patent: Sep. 13, 2011

(54) SINGLE CAN-TYPE COMPOSITE HEAT SOURCE MACHINE

(75) Inventors: Hideo Okamoto, Nagoya (JP); Tadayuki Hiraga, Nagoya (JP); Hiroitsu Ohta, Nagoya (JP); Mineyuki Nasu, Nagoya (JP); Hiroaki Sasaki, Nagoya (JP)

(73) Assignee: Rinnai Corporation, Nagoya-Shi, Aichi (JP)

( * ) Notice: Subject to any disclaimer, the term of this patent is extended or adjusted under 35 U.S.C. 154(b) by 551 days.

(21) Appl. No.: 12/225,309

(22) PCT Filed: Nov. 29, 2006

(86) PCT No.: PCT/JP2006/323791

§ 371 (c)(1),
(2), (4) Date: Sep. 18, 2008

(87) PCT Pub. No.: WO2007/122765

PCT Pub. Date: Nov. 1, 2007

(65) Prior Publication Data

US 2010/0229804 A1 Sep. 16, 2010

(30) Foreign Application Priority Data

Apr. 24, 2006 (JP) ..... 2006-119704

(51) Int. Cl.
*F22B 1/02* (2006.01)

(52) U.S. Cl. ..... 122/31.1; 122/32; 165/104.14

(58) Field of Classification Search ..... 122/18.1, 122/18.3, 18.31, 20 R, 31.1, 32, 38; 165/47, 165/104.14, 104.19, 104.22
See application file for complete search history.

(56) References Cited

U.S. PATENT DOCUMENTS

| | | | | |
|---|---|---|---|---|
| 4,671,212 | A * | 6/1987 | Smith | 122/18.2 |
| 6,606,968 | B2 * | 8/2003 | Iwama et al. | 122/18.1 |
| 7,322,532 | B2 * | 1/2008 | Takada et al. | 236/11 |
| 7,458,340 | B2 * | 12/2008 | Takeda et al. | 122/31.1 |
| 7,600,489 | B2 * | 10/2009 | Lomax et al. | 122/31.1 |
| 7,647,897 | B2 * | 1/2010 | Ootomo et al. | 122/33 |
| 2008/0277097 | A1 * | 11/2008 | Min | 165/104.14 |
| 2009/0133642 | A1 * | 5/2009 | Asakura et al. | 122/32 |

FOREIGN PATENT DOCUMENTS

| | | | |
|---|---|---|---|
| JP | 2-17784 | B2 | 4/1990 |
| JP | 2004-198065 | A | 7/2004 |
| JP | 2004-271109 | A | 9/2004 |
| JP | 2005-331222 | A | 12/2005 |
| JP | 2005-337543 | A | 12/2005 |

* cited by examiner

*Primary Examiner* — Gregory A Wilson
(74) *Attorney, Agent, or Firm* — Birch, Stewart, Kolasch & Birch, LLP

(57) ABSTRACT

A single can-type composite heat source machine including a single can body including a first combustion section having a first burner and a hot water supplying first main heat exchanger located above the first burner, and a second combustion section having a second burner and a second main heat exchanger located above the second burner and used for a purpose other than hot water supply. The first combustion section and the second combustion section are partitioned from each other by a partition wall and juxtaposed in a lateral direction. The machine includes a first auxiliary heat exchanger and a second auxiliary heat exchanger both of a latent heat recovery type connected to upstream sides of the first main heat exchanger and the second main heat exchanger, respectively. An exhaust system can be miniaturized and simplified in spite of provision of the auxiliary heat exchangers.

5 Claims, 7 Drawing Sheets

SINGLE CAN-TYPE COMPOSITE HEAT SOURCE MACHINE

TECHNICAL FIELD

The present invention relates to a single can-type composite heat source machine having a hot water supplying function and a function other than hot water supply, such as heating.

BACKGROUND ART

There is conventionally known a single can-type composite heat source machine which comprises a single can body including a first combustion section having a first burner and a hot water supplying first heat exchanger located above the first burner, and a second combustion section having a second burner and a second heat exchanger located above the second burner and used for a purpose other than hot water supply, the first combustion section and the second combustion section being partitioned from each other by a partition wall and juxtaposed in a lateral direction (see, for example, Japanese Patent Publication No. H2-17784).

Furthermore, besides the composite heat source machine, a hot water supplying heat source machine is conventionally known which has an auxiliary heat exchanger of a latent heat recovery type which is located in an exhaust hood disposed on a top surface of a can body and which is connected to an upstream side of a hot water supplying main heat exchanger so that water vapor in an exhaust gas from a burner having passed through the main heat exchanger is condensed by the auxiliary heat exchanger and so that water to be supplied to the main heat exchanger is preheated in the auxiliary heat exchanger by means of the latent heat of the water vapor (see, for example, Japanese Patent Laid-Open No. 2004-198065). The thus provided auxiliary heat exchanger enables recovery of the latent heat, improving heat efficiency. Thus, the single can-type composite heat source machine desirably has the auxiliary heat exchanger to improve the heat efficiency.

Here, when the auxiliary heat exchanger is located in the exhaust hood, a guide plate inclined so that a rear part of the guide plate is higher than a front part thereof is generally provided in a lower part in the exhaust hood to divert the exhaust gas to a rear part in the exhaust hood and then to guide the exhaust gas forward. The auxiliary heat exchanger is located above the guide plate in the space in the exhaust hood. This configuration enables condensed water falling from the auxiliary heat exchanger to be received by the guide plate, preventing the condensed water from falling into the can body. Moreover, since the exhaust gas flows in a front-back direction with respect to the auxiliary heat exchanger, the height of the exhaust hood can be reduced. Furthermore, the auxiliary heat exchanger comprises a plurality of straight heat absorbing tubes provided in the exhaust hood so as to extend in the lateral direction between side plates arranged on the opposite lateral sides of the exhaust hood. The heat absorbing tubes are connected together on an outer surface of each of the side plates of the exhaust hood via U bents (U-shaped bent tube) each for two heat absorbing tubes. This constitutes continuous heat exchanging channels extending from upstream ends of the heat absorbing tubes to downstream ends of the heat absorbing tubes. Then, the water flowing through the heat exchanging channels is heated by the latent heat of the water vapor in the exhaust gas concentrated on the outer surface of each of the heat absorbing tubes.

Thus, when the single can-type composite heat source machine is configured to comprise the first and second auxiliary heat exchangers connected to the upstream sides of the first and second main heat exchangers, respectively, arranged in the upper part of the can body, the following configuration is generally adopted. Paired exhaust hoods for the first and second combustion sections are arranged on the top surface of the can body; each of the paired exhaust hoods has the guide plate in the lower part similarly to the above-described exhaust hood. A plurality of straight heat absorbing tubes constituting each of the auxiliary heat exchangers are laterally provided above the guide plate in the space in each of the exhaust hoods. The heat absorbing tubes are connected together, via the U bents each for two heat absorbing tubes, on the outer surface of each of the side plates arranged on the opposite lateral sides of the exhaust hood, to constitute the continuous heat exchanging channels.

However, this configuration requires the separate exhaust hoods for the first combustion section and the second combustion section, thus complicating the structure and increasing costs. Moreover, an installation space for the U bents needs to be provided between the exhaust hoods for the first combustion section and the second combustion section. Thus, the widths of both exhaust hoods needs to be increased outward in the lateral direction, thus increasing the size of an exhaust system.

DISCLOSURE OF THE INVENTION

Problem to be Solved by the Invention

In view of these circumstances, an object of the present invention is to provide a single can-type composite heat source machine that allows an exhaust system to be miniaturized and simplified in spite of provision of auxiliary heat exchangers of a latent heat recovery type.

Means for Solving the Problem

To attain the above-described object, the present invention provides a single can-type composite heat source machine comprising a single can body including a first combustion section having a first burner and a hot water supplying first main heat exchanger located above the first burner, and a second combustion section having a second burner and a second main heat exchanger located above the second burner and used for a purpose other than hot water supply, the first combustion section and the second combustion section being partitioned from each other by a partition wall and juxtaposed in a lateral direction, the machine comprising a first auxiliary heat exchanger of a latent heat recovery type connected to an upstream side of the first main heat exchanger and a second auxiliary heat exchanger of a latent heat recovery type connected to an upstream side of the second main heat exchanger, the machine being characterized in that a common exhaust hood straddling both the first and second combustion sections is located on a top surface of the can body, and a guide plate inclined so that a rear part of the guide plate is higher than a front part thereof is provided in a lower part of the exhaust hood to divert an exhaust gas to a rear part in the exhaust hood and then to guide the exhaust gas forward, and an exhaust partition wall is provided in the exhaust hood to partition a space in the exhaust hood into a first exhaust space through which an exhaust gas from a first burner having passed through the first main heat exchanger flows and a second exhaust space through which an exhaust gas from a second burner having passed through the second main heat exchanger flows, in that the first auxiliary heat exchanger is located above the guide plate in the first exhaust space, and the second auxiliary heat exchanger is located above the guide plate in the second exhaust space, and in that each of the first and second auxiliary heat exchangers comprises a meandering heat absorbing tube having a laterally inward U turn section that turns around, without penetrating the exhaust partition wall, on a side of a surface of the exhaust partition wall located opposite a target side plate that is one of side plates provided on opposite lateral sides of the exhaust hood, the target side plate being positioned laterally outside an exhaust space in which each of the auxiliary heat exchanger is located, and the exhaust partition wall has a heat absorbing tube fixing section to which the laterally inward U turn sections of the heat absorbing tubes in the auxiliary heat exchangers are fixed.

According to the present invention, the guide plate receives condensed water resulting from condensation of water vapor in the first and second auxiliary heat exchangers. Thus, the condensed water can be prevented from falling into the can body. Furthermore, the exhaust gas flows in a front-back direction with respect to each of the auxiliary heat exchangers. The height of the exhaust hood can thus be reduced. The present invention is similar to the prior art in this regard. However, in the present invention, the heat absorbing tubes in the first and second auxiliary heat exchangers have the meander shape having the laterally inward U turn section that avoids penetrating the exhaust partition wall. Thus, in contrast to a configuration in which straight heat absorbing tubes are connected together via U bents outside each exhaust space, the present invention does not require the installation space for the U bents between the first and second exhaust spaces. Consequently, simply by providing the exhaust partition wall in the single exhaust hood common to the first and second combustion sections, both the first and second auxiliary heat exchangers can be arranged. An exhaust system can thus be miniaturized and simplified, thus reducing costs. Furthermore, the U bents do not function as a heat exchanging section. However, the U turn section of the heat absorbing tube according to the present invention turns around in the target exhaust space without penetrating the exhaust partition wall. Thus, the U turn section functions effectively as a heat exchanging section that recovers latent heat in the exhaust gas flowing along the wall surface of the exhaust partition wall in the exhaust space. This improves heat efficiency.

The heat absorbing tube in each of the auxiliary heat exchanger may have a meander shape like the letter U which has only one laterally inward U turn section between the upstream end and downstream end of the tube. Alternatively, a plurality of U-shaped unit heat absorbing tubes each having a laterally inward U turn section may be provided, and every two of the unit heat absorbing tubes may be connected together via a U bent on an outer surface of the target side plate so that the unit heat absorbing tubes as a whole constitute a heat absorbing tube meandering plural times in the lateral direction. However, in this case, the U bent does not function as a heat exchanging section. In contrast, when each of the heat absorbing tubes is shaped to meander plural times in the lateral direction, that is, the heat absorbing tube has, in addition to the laterally inward U turn section, a laterally outward U turn section that turns around on the target side plate side without penetrating the target side plate, the laterally outward U turn section functions as a heat exchanging section that recovers the latent heat in the exhaust gas flowing along an inner surface of the target side plate. This configuration is thus advantageous in improving heat efficiency. Furthermore, if the exhaust partition wall has a heat absorbing fixing section to which the laterally inward U turn sections of the heat absorbing tubes in the auxiliary heat exchangers are fixed, and the laterally outward U turn section is formed in each of the heat absorbing tubes in each auxiliary heat exchanger, a heat absorbing tube fixing section to which the laterally outward U turn sections are fixed is provided on the target side plate. Then, the heat absorbing tubes can advantageously be prevented from being vibrated or deformed by water hammer.

Furthermore, desirably, the guide plate is formed to be continuous in the lateral direction across both the first and second exhaust spaces, and the exhaust partition wall is divided into two parts, an upper half section positioned above the guide plate and a lower half section positioned below the guide plate. Here, ensuring the sealability of a junction between the guide plate and the exhaust partition wall is difficult. If the exhaust partition wall is not divided into two parts and the guide plate is divided into two parts for the first exhaust space and the second exhaust space, respectively, condensed water may leak from the junction between the guide plate and the exhaust partition wall and fall into the can body. In contrast, when the exhaust partition wall is divided into two parts so as to be continuous in the lateral direction, the condensed water can be prevented from falling into the can body.

Each of the first and second main heat exchangers generally comprises a large number of heat absorbing fins stacked with front-back gaps created among the heat absorbing fins and a plurality of heat absorbing tubes extending long in the front-back direction so as to penetrate the heat absorbing fins. The heat absorbing tubes are connected together via U bents each for two heat absorbing tubes on outer surfaces of plates arranged in a front and a rear of the can body so as to constitute continuous heat exchanging channels each extending from upstream end of the heat absorbing tubes to downstream end of the heat absorbing tubes. In this case, the upstream-end heat absorbing tube and the downstream-end heat absorbing tube in each of the first and second main heat exchangers are positioned laterally outward in the main heat exchanger, and upstream ends and downstream ends of the heat absorbing tubes in each of the first and second auxiliary heat exchangers penetrate the target side plate. Consequently, the following connection sections are separately disposed on one side and the other side of the heat source machine in the lateral direction: the connection section of a tubing member for the first combustion section for the first auxiliary heat exchanger and the first main heat exchanger and the connection section of a tubing member for the second combustion section for the second auxiliary heat exchanger and the second main heat exchanger. Thus, tubing operations and leakage inspections are facilitated. This configuration further reduces the distance between the downstream-end heat absorbing tube and the upstream-end heat absorbing tube in each of the auxiliary heat exchangers. This in turn prevents a wasteful increase in the length of the connection tube between each of the auxiliary heat exchangers and the corresponding main heat exchanger, thus reducing costs.

DESCRIPTION OF SYMBOLS

1 . . . Can body, 2*a* . . . Partition wall, 3-1 . . . First combustion section, 3-2 . . . Second combustion section, 4-1 . . . First burner, 4-2 . . . Second burner, 5-1 . . . First main heat exchanger, 5-2 . . . Second main heat exchanger, 5*a* . . . Heat absorbing fin, 5*b* . . . Heat absorbing tube, 5*b*-S . . . Upstream-end heat absorbing tube, 5*b*-E . . . Downstream-end heat absorbing tube, 5*c* . . . U bent, 9 . . . Exhaust hood, 9*b* . . . Guide plate, 9*c* . . . Exhaust partition wall, 9*e* . . . Side plate, 9*f* . . . Heat absorbing tube fixing section, 10-1 . . . First exhaust space, 10-2 . . . Second exhaust space, 11-1 . . . First auxiliary heat exchanger, 11-2 . . . Second auxiliary heat exchanger, 11*a* . . . Heat absorbing tube, 11*b* . . . Laterally inward U turn section, 11*c* . . . Laterally outward U turn section.

BEST MODE FOR CARRYING OUT THE INVENTION

Figure 1:
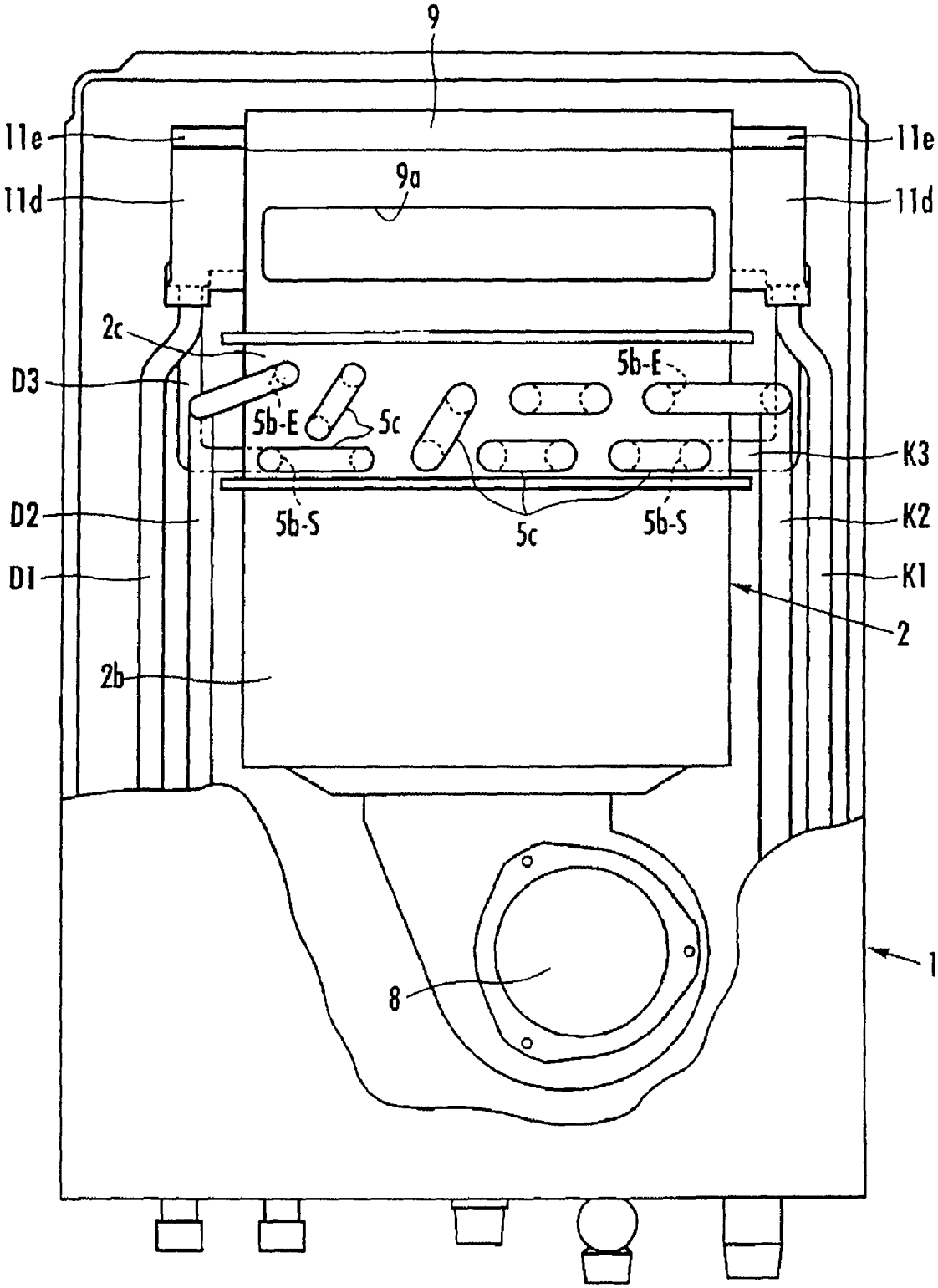
FIG. 1 is a front view of a heat source machine according to a first embodiment of the present invention.
Figure 2:
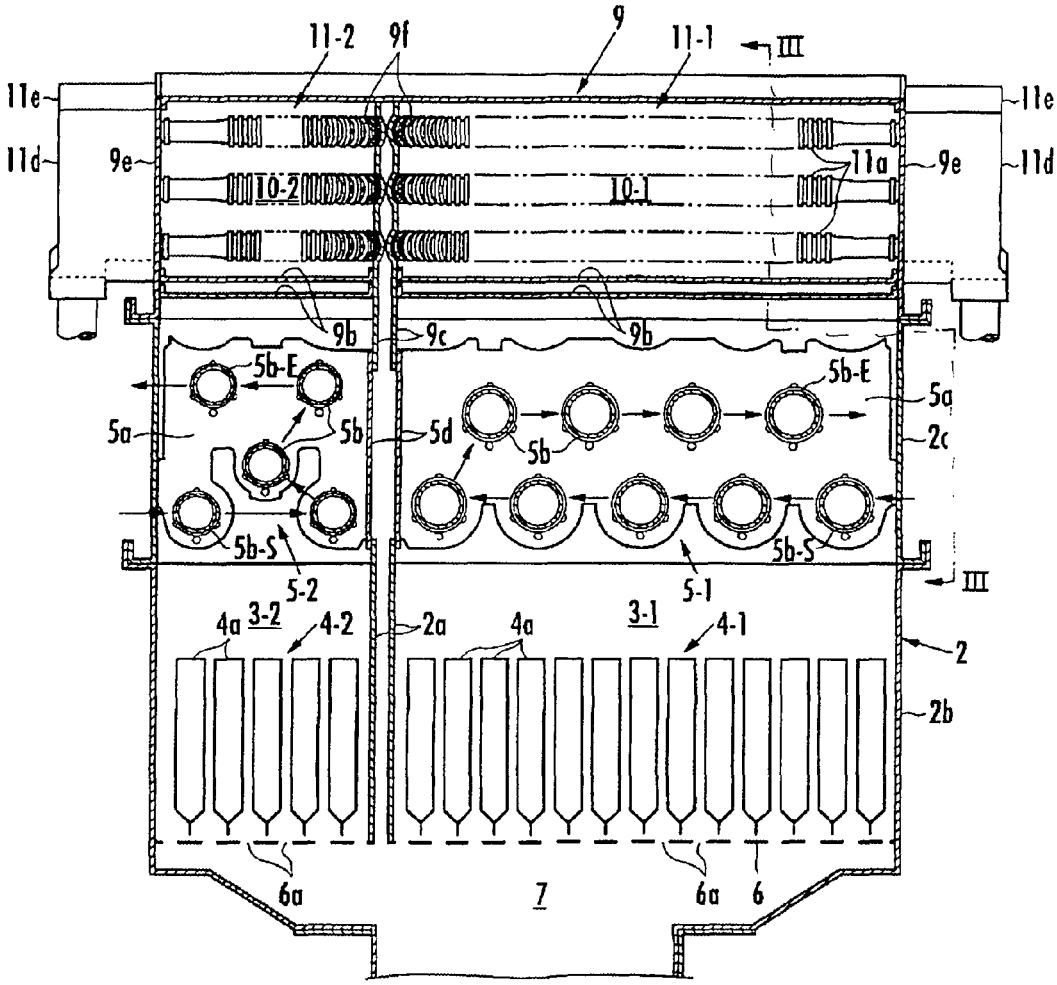
FIG. 2 is a cutaway front view of a part of the heat source machine according to the first embodiment which includes a can body and an exhaust hood.

With reference to FIG. 1, a reference numeral 1 denotes an outer case of a heat source machine in which a single can body 2 is located. As shown in FIG. 2, in the can body 2, a hot water supplying first combustion section 3-1 and a heating second combustion section 3-2 are partitioned from each other by a partition wall 2*a* and juxtaposed in a lateral direction so as to constitute a single can-type composite heat source machine. The first combustion section 3-1 has a first burner 4-1 and a first main heat exchanger 5-1 located above the first burner 4-1. The second combustion section 3-2 has a second burner 4-2 and a second main heat exchanger 5-2 located above the second burner 4-2. The can body 2 is composed of a lower half section 2*b* that houses both the first and second burners 4-1 and 4-2 and an upper half section 2*c* that houses both the first and second main heat exchangers 5-1 and 5-2.

Each of the first and second burners 4-1 and 4-2 is configured such that a plurality of unit burners 4*a* extending long in a front-back direction corresponding to an inward direction of the can body 2 (the direction perpendicular to the sheet of FIG. 1) are juxtaposed in the lateral direction. Since hot water supply requires a higher heating capability than room heating, the number of unit burners 4*a* constituting each of the burners 4-1 and 4-2 is larger in the first burner 4-1 than in the second burner 4-2.

Figure 3:
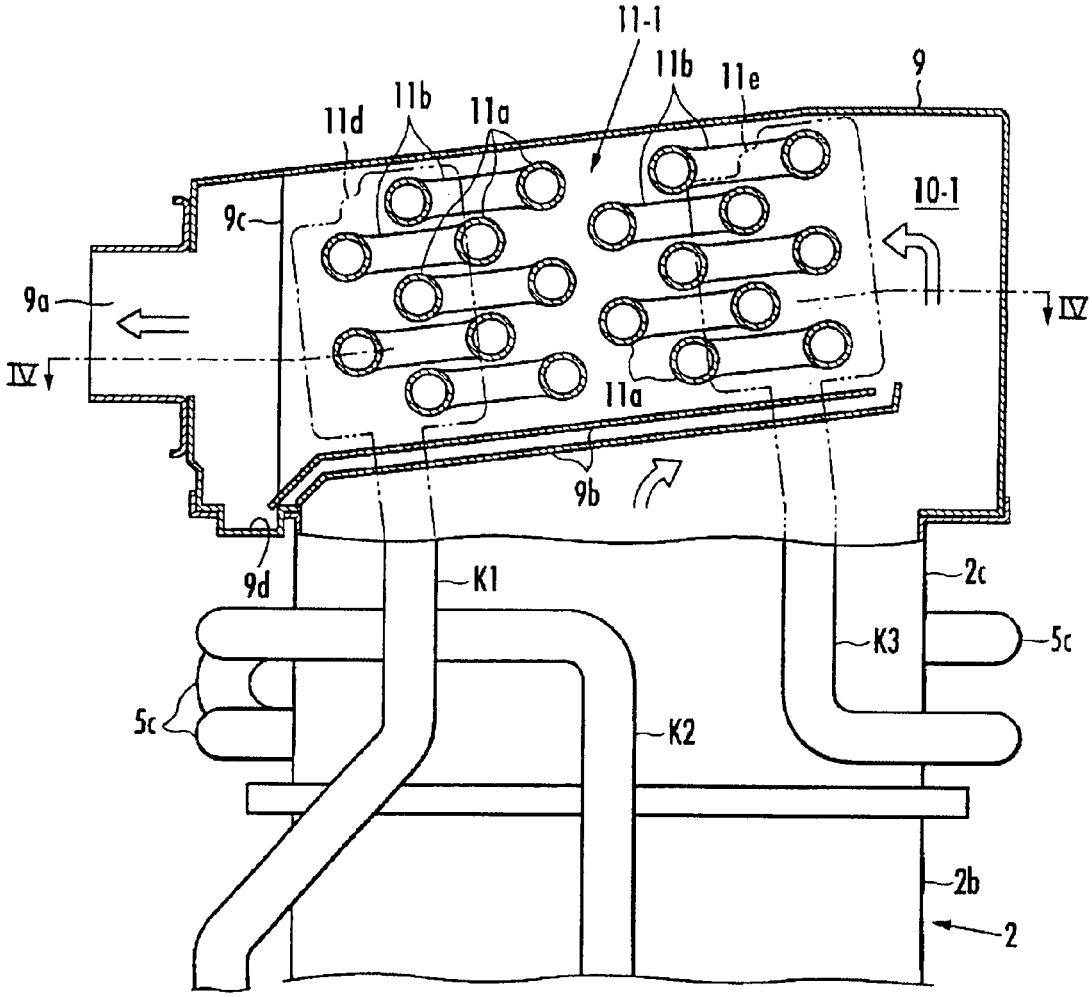
FIG. 3 is a cutaway side view taken along line III-III in FIG. 2.

Each of the main heat exchangers 5-1 and 5-2 is composed of a large number of heat absorbing fins 5*a* stacked with front-back gaps created among the heat absorbing fins, and a plurality of heat absorbing tubes 5*b* extending long in the front-back direction so as to penetrate the heat absorbing fins 5*a*. As shown in FIGS. 1 and 3, the heat absorbing tubes 5*b* in each of the main heat exchangers 5-1 and 5-2 are connected together via U bents 5*c* each for two heat absorbing tubes on outer surfaces of plates located in the front and rear, respectively, of the can body 2, to constitute continuous heat exchanging channels each extending from an upstream-end heat absorbing tube 5*b*-S to a downstream-end heat absorbing tube 5*b*-E. A water supply tube K1 is connected to the upstream-end heat absorbing tube 5*b*-S in the first main heat exchanger 5-1 via a first auxiliary heat exchanger 11-1 to be described below. A hot water exit tube K2 is connected to the downstream-end heat absorbing tube 5*b*-E. When a downstream-end hot water tap (not shown in the drawings) of the hot water exit tube K2 is opened to allow water to flow through the first auxiliary heat exchanger 11-1 and the first main heat exchanger 5-1, the first burner 4-1 is ignited and the hot water heated by the first auxiliary heat exchanger 11-1 and the first main heat exchanger 5-1 is flown out through the hot water exit tap. Furthermore, a backward tube D1 in a heating circuit is connected to the upstream-end heat absorbing tube 5*b*-S in the second main heat exchanger 5-2 via a second auxiliary heat exchanger 11-2 to be described below. A forward tube D2 in the heating circuit is connected to the downstream-end heat absorbing tube 5*b*-E. When a heating pump provided in the heating circuit (not shown in the drawings) operates to allow water to flow through the second auxiliary heat exchanger 11-2 and the second main heat exchanger 5-2, the second burner 4-2 is ignited and the hot water heated by the second auxiliary heat exchanger 11-2 and the second main heat exchanger 5-2 is supplied to a heating terminal via the heating circuit for heating.

The upstream-end heat absorbing tube 5*b*-S and the downstream-end heat absorbing tube 5*b*-E in each of the main heat exchangers 5-1 and 5-2 are positioned in a lower part and an upper part, respectively, of a laterally outward part in each of the main heat exchangers 5-1 and 5-2. As shown by arrows in FIG. 2, heat exchanging channels are configured so as to extend laterally inward of the main heat exchangers 5-1 and 5-2 from the upstream-end heat absorbing tube 5*b*-S in the lower part of each of the main heat exchangers 5-1 and 5-2, then to turn around (U-turn) in the laterally inward part, and then to extend laterally outward in the upper part of each of the main heat exchangers 5-1 and 5-2 to the downstream-end heat absorbing tube 5*b*-E.

An air supply chamber 7 partitioned by a distribution plate 6 is defined for the first and second combustion sections 3-1 and 3-2 in the lower part of the can body 2. A combustion fan 8 is connected to the air supply chamber 7 so that air from the combustion fan 8 is fed from the air supply chamber 7 to each of the combustion sections 3-1 and 3-2 via a large number of distribution holes 6*a* formed in the distribution plate 6. Furthermore, a single exhaust hood 9 is located on a top surface of the can body 2 common to both combustion sections 3-1 and 3-2 so as to straddle both combustion sections 3-1 and 3-2. Exhaust gases from the first and second burners 4-1 and 4-2 are guided to the first and second main heat exchangers 5-1 and 5-2, respectively, to perform heat exchange therein. The exhaust gases then flow to the exhaust hood 9 and are then discharged to the exterior through an exhaust port 9*a* formed in a front surface of the exhaust hood 9.

The partition wall 2*a* is formed with an internal cavity by two plates. Air from the air supply chamber 7 is allowed to flow into the internal cavity in the partition wall 2*a* to cool the partition wall 2*a*. Furthermore, an upper end of the partition wall 2*a* is inserted slightly into a gap between the first and second main heat exchangers 5-1 and 5-2 and is ended there. The gap is positioned at the boundary between the first and second combustion sections 3-1 and 3-2. In this arrangement only, the exhaust gas having flowed into one of the main heat exchangers 5-1 and 5-2 may flow to the other main heat exchanger via the gap between the main heat exchangers 5-1 and 5-2. Then, during an independent operation of hot water supply or heating in which only one of the first and second combustion sections 3-1 and 3-2 is operated for combustion, the stopped combustion section of the main heat exchangers may be overheated.

Thus, in the present embodiment, a sealing section 5*d* is provided at a laterally inward side end of each of the main heat exchangers 5-1 and 5-2 to seal the gaps among heat absorbing fins 5*a* in each of the main heat exchangers 5-1 and 5-2. The sealing section 5*d* prevents the exhaust gas having flown into each of the main heat exchangers 5-1 and 5-2 from flowing into the other main heat exchanger. That is, the sealing section 5*d* functions as a part of the partition wall 2*a*. Here, the sealing section 5*d* can be formed by folding a side end of each heat absorbing fins 5*a* so that the side end abuts against the adjacent heat absorbing fin 5*a*. However, the sealing section 5*d* can be composed of plates different from the heat absorbing fins 5*a* attached to the side end of each of the main heat exchangers 5-1 and 5-2. Alternatively, the sealing section 5*d* may be omitted provided that the partition wall 2*a* is formed such that the height of the upper end of the partition wall 2*a* is equal to or larger than that of an upper end of the gap between the main heat exchangers 5-1 and 5-2.

Figure 4:
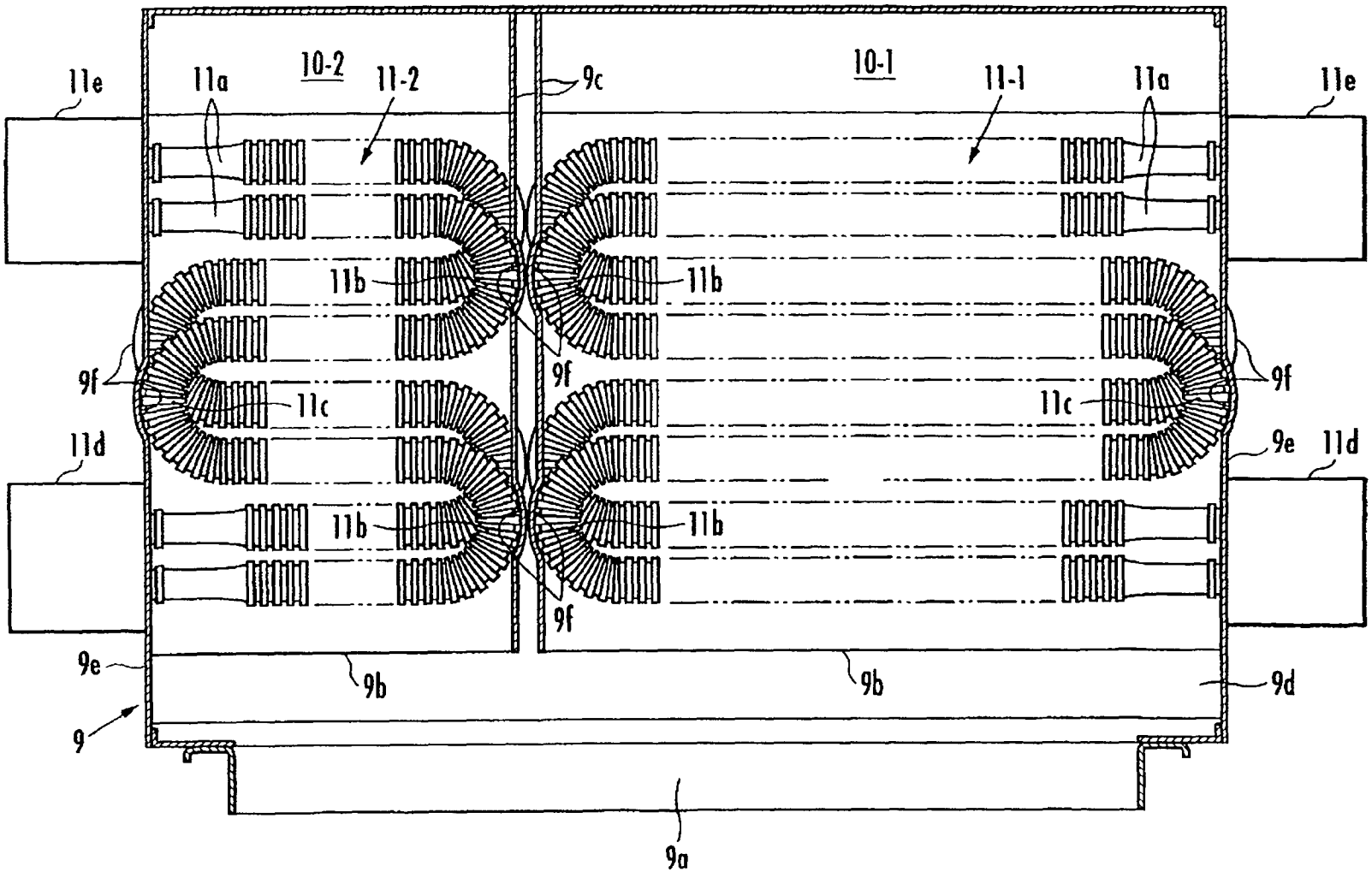
FIG. 4 is a cutaway plan view taken along line IV-IV in FIG. 3.

As shown in FIG. 3, a guide plate 9*b* inclined such that a rear part of the guide plate 9*b* is higher than a front part thereof is provided in the lower part in the exhaust hood 9 to divert the exhaust gas to a rear part in the exhaust hood 9 and then to guide the exhaust gas forward. Furthermore, as shown in FIGS. 2 and 4, an exhaust partition wall 9*c* is provided in an area positioned above the boundary portion between the combustion sections 3-1 and 3-2 in the exhaust hood 9 to partition the space in the exhaust hood 9 into a first exhaust space 10-1 through which the exhaust gas from the first burner 4-1 having passed through the first main heat exchanger 5-1 and a second exhaust space 10-2 through which the exhaust gas from the second burner 4-2 having passed through the second main heat exchanger 5-2. The first auxiliary heat exchanger 11-1 of a latent heat recovery type is located above the guide plate 9*b* in the first exhaust space 10-1. The second auxiliary heat exchanger 11-2 of the latent heat recovery type is located above the guide plate 9*b* in the second exhaust space 10-2.

The water supply tube K1 is connected to the upstream side of the first auxiliary heat exchanger 11-1. The first main heat exchanger 5-1 is connected to the downstream side of the first auxiliary heat exchanger 11-1 via a connection tube K3. Thus, water vapor in the exhaust gas from the first burner 4-1 having passed through the first main heat exchanger 5-1 is condensed in the first auxiliary heat exchanger 11-1. City water from the water supply tube K1 is preheated in the first auxiliary heat exchanger 11-1 by means of the latent heat of the water vapor and then fed to the first main heat exchanger 5-1. Furthermore, the backward tube D1 in the heating circuit is connected to the upstream side of the second auxiliary heat exchanger 11-2. The second main heat exchanger 5-2 is connected to the downstream side of the second auxiliary heat exchanger 11-2 via a connection tube D3. Thus, water vapor in the exhaust gas from the second burner 4-2 having passed through the second main heat exchanger 5-2 is condensed in the second auxiliary heat exchanger 11-2. Heating back water from the backward tube D1 is preheated in the second auxiliary heat exchanger 11-2 by means of the latent heat of the water vapor and then fed to the second main heat exchanger 5-2. Condensed water resulted from the condensation of the water vapor in each of the auxiliary heat exchangers 11-1 and 11-2 falls onto the guide plate 9*b* and is then guided to a discharge section 9*d* located in a lower part of a front end of the exhaust hood 9 via the guide plate 9*b*. The guide plate 9*b* may be cooled by the condensed water falling onto the guide plate 9*b* to cool the exhaust gas, resulting in condensation on a bottom surface of the guide plate 9*b*. Thus, in the present embodiment, the guide plate 9*b* is composed of an upper plate and a lower plate so that a heat insulating air layer is formed between the two plates to prevent the possible condensation on the bottom surface of the guide plate 9*b*.

An exhaust port can be formed in a top surface of the exhaust hood 9 so that the exhaust gases can be allowed to flow from the lower part of each of the auxiliary heat exchangers 11-1 and 11-2 toward the exhaust port to the auxiliary heat exchangers 11-1 and 11-2. However, in this case, the height dimension of the exhaust hood 9 needs to be increased in order to provide each of the auxiliary heat exchangers 11-1 and 11-2 with an appropriate length in an exhaust flow direction. In contrast, in the present embodiment, the exhaust gas flows forward from the rear of each of the auxiliary heat exchangers 11-1 and 11-2 toward the exhaust port 9*a* in the front surface of the exhaust hood 9 to the auxiliary heat exchangers 11-1 and 11-2. Thus, each of the auxiliary heat exchangers 11-1 and 11-2 can have the appropriate length in the exhaust flow direction without the need to increase the height dimension of the exhaust hood 9. This is advantageous in miniaturizing the exhaust system.

As shown in FIGS. 2 to 4, each of the first and second auxiliary heat exchangers 11-1 and 11-2 comprises a plurality of (in the illustrated example, five) heat absorbing tubes 11*a* extending from a front side toward a rear side between the exhaust partition wall 9*c* and a target side plate 9*e* while meandering plural times in the lateral direction; the target side plate 9*e* is one of two side plates 9*e*, 9*e* which are arranged on the opposite lateral sides of the exhaust hood 9 and positioned laterally outside the exhaust space 10-1 and 10-2, in which the auxiliary heat exchanger 11-1 and 11-2, respectively, are located. Each of the heat absorbing tubes 11*a* has a laterally inward U turn section 11*b* that turns around on the side of a surface of the exhaust partition wall 9*c* located opposite the target side plate 9*e*, without penetrating the exhaust partition wall 9*c*, and a laterally outward U turn section 11*c* that turns around on the side of the target side plate 9*e* without penetrating the target side plate 9*e*. The heat absorbing tubes 11*a* are formed of stainless steel so as to be prevented from being corroded by the condensed water, which exhibits a strong acidity when nitrogen oxide or the like in the exhaust gas is dissolved into the condensed water. Here, both the auxiliary heat exchangers 11-1 and 11-2 may have heat absorbing fins. However, in this case, the heat absorbing fins also need to be formed of stainless steel and thus have a reduced heat conductivity. Consequently, the provision of the heat absorbing fins fails to significantly improve recovery efficiency. Thus, instead of the heat absorbing fins, corrugated recesses and protrusions are provided on each of the heat absorbing tubes 11*a* to increase the surface area thereof.

The auxiliary heat exchangers 11-1 and 11-2 may each be composed of a plurality of straight heat absorbing tubes provided in the exhaust space 10-1 and 10-2, respectively, so as to extend in the lateral direction between the exhaust partition plate 9*c* and the target side plate 9*e*, with the heat absorbing tubes connected together via U bents each for two heat absorbing tubes outside each of the exhaust spaces 10-1 and 10-2. However, in this case, the U bents connecting, outside the exhaust partition wall 9*c*, the heat absorbing tubes for the first auxiliary heat exchanger 11-1, located in the first exhaust space 10-1, are installed in the second exhaust space 10-2. The U bents connecting, outside the exhaust partition wall 9*c*, the heat absorbing tubes for the second auxiliary heat exchanger 11-2, located in the second exhaust space 10-2, are installed in the first exhaust space 10-1. Then, during an independent operation of hot water supply or heating, the U bents in the auxiliary heat exchanger on the side of the stopped combustion section are exposed to and overheated by the exhaust gas flowing through the exhaust space on the side of the operating combustion section. Furthermore, the U bents in the auxiliary heat exchanger on the side of the operating combustion section are exposed to air flowing through the exhaust space on the side of the stopped combustion section, resulting in a heat radiation loss. To solve this problem, an installation space for the U bents needs to be provided between the first and second exhaust spaces 10-1 and 10-2. As a result, separate exhaust hoods for the first and second combustion sections 3-1 and 3-2 need to be arranged away from each other in the lateral direction so as to provide the installation space for the U bents between the exhaust hoods, with the auxiliary heat exchangers 11-1 and 11-2 arranged in the respective exhaust hoods. This increases the size and complicatedness of the exhaust system.

In contrast, in the present embodiment, the heat absorbing tubes 11*a* in the auxiliary heat exchangers 11-1 and 11-2 are formed to meander in the lateral direction in the exhaust spaces 10-1 and 10-2, respectively. This eliminates the need to provide the installation space for the U bents between the first and second exhaust spaces 10-1 and 10-2. Consequently, simply by providing the exhaust partition wall 9*c* in the single exhaust hood 9 common to the first and second combustion sections 3-1 and 3-2, each of the first and second auxiliary heat exchangers 11-1 and 11-2 can be located so as to be prevented from being thermally affected by the irrelevant combustion section. This miniaturizes and simplifies the exhaust system, thus reducing costs. Although the U bents do not function as a heat exchanging section, the laterally inward and outward U turn sections 11*b* and 11*c* of each of the heat absorbing tubes 11*a* of the present embodiment are accommodated in the corresponding exhaust space 10-1 or 10-2 without penetrating the exhaust partition wall 9*c* or the target side plate 9*e*; thus, the U turn sections 11*b* and 11*c* effectively function as a heat exchanging section that recovers latent heat from the exhaust gas flowing along a wall surface of the exhaust partition wall 9*c* and an inner surface of the target side plate 9*e*, thereby improving heat efficiency.

Furthermore, in the present embodiment, each of the exhaust partition wall 9*c* and the target side plate 9*e* has heat absorbing tube fixing sections 9*f* to which the laterally inward and outward U turn sections 11*b* and 11*c* of each of the heat absorbing tubes 11*a* in each of the auxiliary heat exchangers 11-1 and 11-2 are fixed. Thus, each of the U turn sections 11*b* and 11*c* is firmly supported by the exhaust partition wall 9*c* and the target side plate 9*e*. This prevents the heat absorbing tubes 11*a* from being vibrated or deformed by water hammer. In the present embodiment, recesses are formed in the exhaust partition wall 9*c* and the target side plate 9*e* so that ends of the U turn sections 11*b* and 11*c* can be received in the recesses. The recesses constitute the heat absorbing tube fixing sections 9*f*. When the target side plate 9*e* is mounted in the exhaust hood 9 so that the heat absorbing tubes 11*a* in the corresponding auxiliary heat exchanger are sandwiched between the target side plate 9*e* and the exhaust partition wall 9*c*, the ends of the laterally inward and outward U turn sections 11*b* and 11*c* are fittingly fixed to the heat absorbing tube fixing sections 9*f* on the exhaust partition wall 9*c* and the target side plate 9*e*.

Here, the exhaust partition wall 9*c* is formed with an internal cavity by two plates. Cooling air having passed through the internal cavity in the partition wall 2*a* flows to the exhaust port 9*a* via the internal cavity in the exhaust partition wall 9*c*. Furthermore, the heat absorbing tube fixing sections 9*f* are formed in each of the plates of the exhaust partition wall 9*c*; the heat absorbing tube fixing sections 9*f* are made up of the recesses that receive the laterally inward U turn sections 11*b* of the heat absorbing tubes 11*a* in the corresponding auxiliary heat exchanger. Thus, the heat absorbing tube fixing sections 9*f* for the first auxiliary heat exchanger 11-1 and the heat absorbing tube fixing sections 9*f* for the second auxiliary heat exchanger 11-2 can be formed at the same positions on opposite lateral sides of the exhaust partition wall 9*c*. This eliminates the need to displace the heat absorbing tubes 11*a* in the first auxiliary heat exchanger 11-1 from the heat absorbing tubes 11*a* in the second auxiliary heat exchanger 11-2.

A front inflow header 11*d* and a rear outflow header 11*e* are attached to an outer surface of each of the side plates 9*e* arranged at the opposite lateral sides of the exhaust hood 9. Front ends, that is, upstream ends of the plurality of heat absorbing tubes 11*a* in each of the auxiliary heat exchangers 11-1 and 11-2 penetrate the target side plate 9*e* to connect to the inflow header 11*d* on the outer surface of the target side plate 9*e*. Furthermore, rear ends, that is, downstream ends of the heat absorbing tubes 11*a* penetrate the target side plate 9*e* to connect to the outflow header 11*e* on the outer surface of the target side plate 9*e*. The water supply tube K1 is connected to the inflow header 11*d* for the first auxiliary heat exchanger 11-1. The outflow header 11*e* for the first auxiliary heat exchanger 11-1 is connected to an upstream-end heat absorbing tube 5*b*-S in the first main heat exchanger 5-1 via the connection tube K3. Thus, city water from the water supply tube K1 flows to the hot water exit tube K2 via the first auxiliary heat exchanger 11-1, the connection tube K3, and the first main heat exchanger 5-1. Furthermore, the backward tube D1 in the heating circuit is connected to the inflow heater 11 for the second auxiliary heat exchanger 11-2. The outflow header 11*e* for the second auxiliary heat exchanger 11-2 is connected to the upstream-end heat absorbing tube 5*b*-S in the second main heat exchanger 5-2 via the connection tube D3. Thus, heated water from the backward tube D1 flows to the forward tube D2 in the heating circuit via the second auxiliary heat exchanger 11-2, the connection tube D3, and the second main heat exchanger 5-2.

Here, the upstream-end heat absorbing tubes 5*b*-S and downstream-end heat absorbing tubes 5*b*-E of the first and second main heat exchangers 5-1 and 5-2 are positioned laterally outward in the main heat exchanger 5-1, 5-2, respectively, as described above. The inflow header 11*d* and the outflow header 11*e*, connecting the upstream and downstream ends of each of the heat absorbing tubes 11*a* in each of the first and second auxiliary heat exchanger 11-1 and 11-2, are arranged on the outer surface of the side plate 9*e*, located outside the each of the first and second exhaust spaces 10-1 and 10-2 in the exhaust hood 9. Consequently, the following connection sections are separately disposed on one side and the other side of the heat source machine in the lateral direction, respectively: the connection section, which is made up of the water supply tube K1, the hot water exit tube K2, and the connection tube K3, of a hot water supplying tubing member for the first main heat exchanger 5-1 and the first auxiliary heat exchanger 11-1, and the connection section, which is made up of the backward tube D1, the forward tube D2, and the connection tube D3, of a heating tubing member for the second main heat exchanger 5-2 and the second auxiliary heat exchanger 11-2. Thus, tubing operations and leakage inspections are facilitated, improving productivity. This configuration further reduces the distance between the outflow header 11*e* for each of the auxiliary heat exchanger tubes 11-1 and 11-2 and the upstream-end heat absorbing tube 5*b*-E in each of the main heat exchangers 5-1 and 5-2. This in turn prevents unnecessary increase in the length of the connection tubes K3 and D3 between the auxiliary heat exchangers 11-1 and 11-2 and the main heat exchangers 5-2 and 5-2, thus reducing costs.

Figure 5:
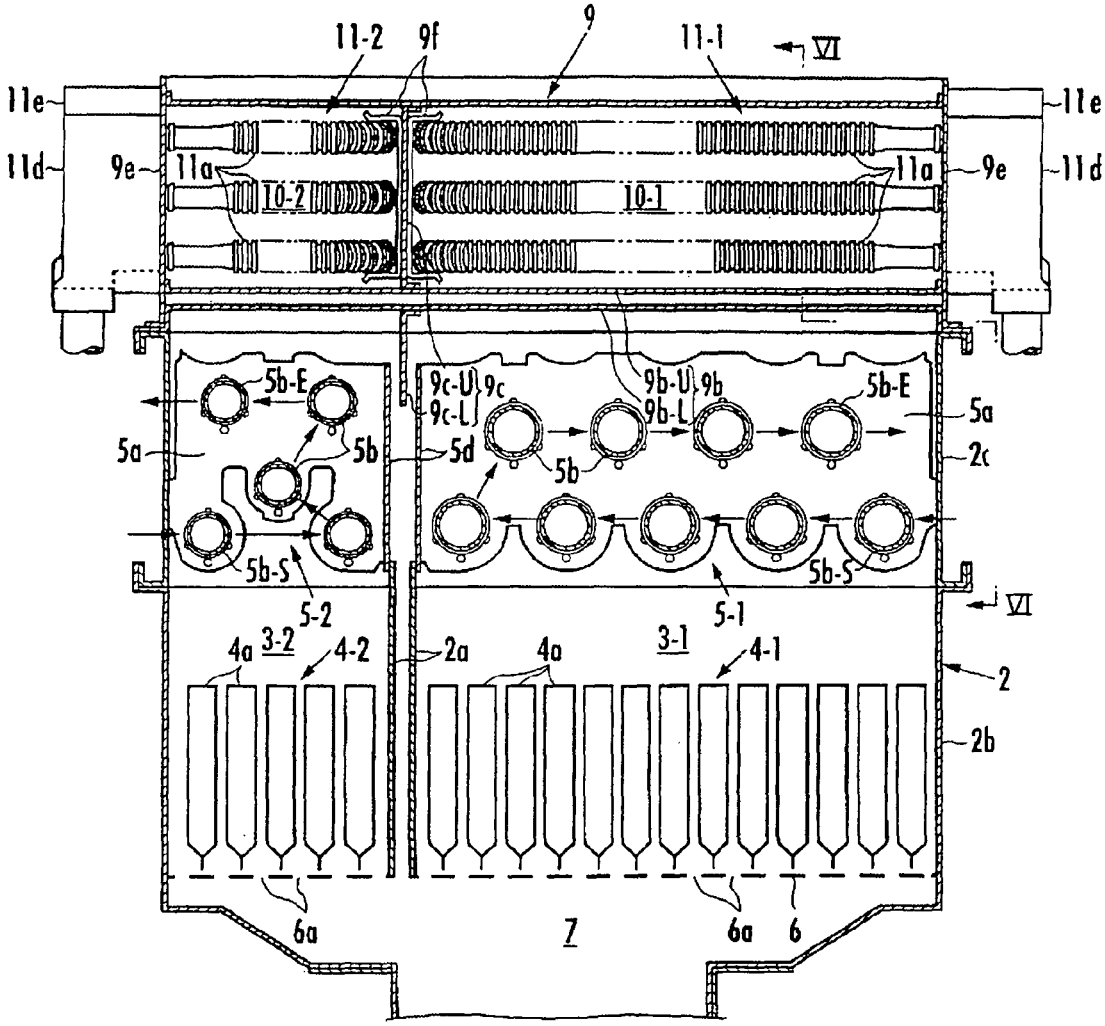
FIG. 5 is a cutaway front view of a heat source machine according to a second embodiment corresponding to FIG. 2.
Figure 6:
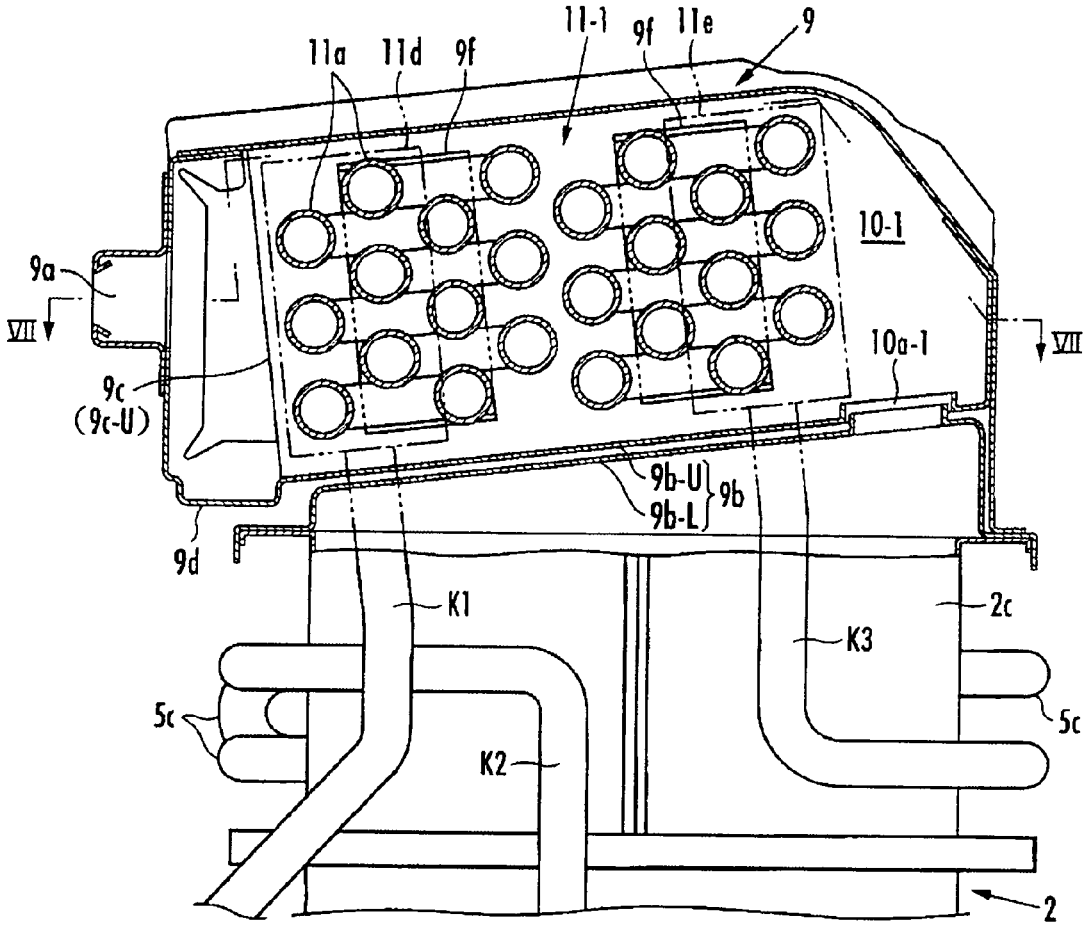
FIG. 6 is a cutaway side view taken along line VI-VI in FIG. 5.
Figure 7:
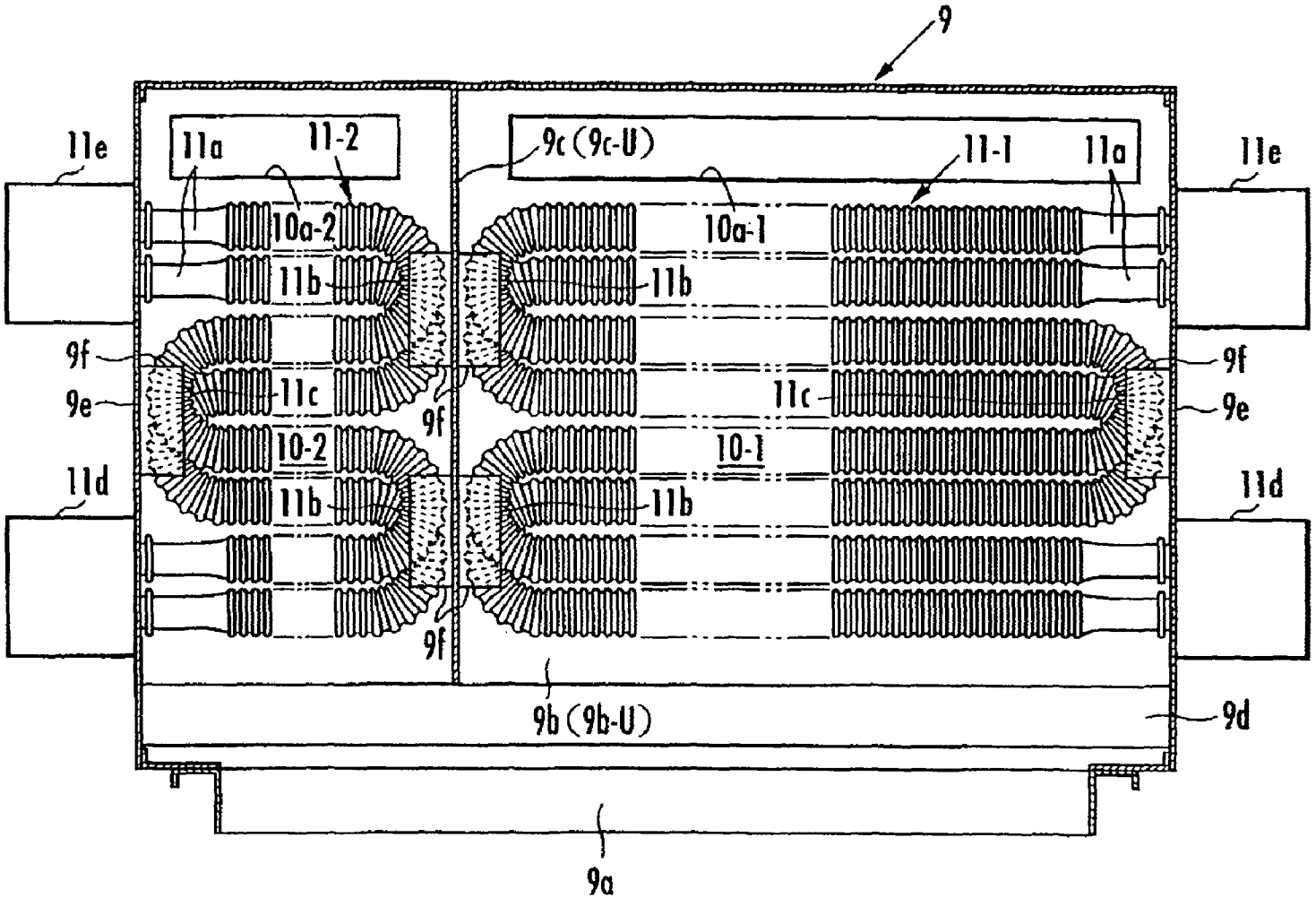
FIG. 7 is a cutaway plan view taken along line VII-VII in FIG. 6.

Hereinafter, a second embodiment shown in FIGS. 5 to 7 will be described. The basic structure of the second embodiment is similar to that of the above-described first embodiment. Members and sections similar to those of the first embodiment are denoted by the same reference numerals. In the first embodiment, the exhaust partition wall 9*c* in the exhaust hood 9 extends upward and downward from the guide plate 9*b* so as to divide the guide plate 9*b* into two parts for the first exhaust space 10-1 and the second exhaust space 10-2, respectively. The two parts of the guide plate 9*b* are joined to the exhaust partition wall 9*c* at laterally inward ends thereof. In this configuration, ensuring the sealability of the junction between the guide plate 9*b* and the exhaust partition wall 9*c* is difficult. Condensed water may leak from the junction between the guide plate 9*b* and the exhaust partition wall 9*c* and fall into the can body 2.

However, in the second embodiment, the guide plate 9*b* is formed to be continuous in the lateral direction across both the first and second exhaust spaces 10-1 and 10-2. The exhaust partition wall 9*c* is divided into two parts, an upper half section 9*c*-U positioned above the guide plate 9*b* and a lower half section 9*c*-L positioned below the guide plate 9*b*. Thus, the possible leakage of condensed water is prevented.

Moreover, in the second embodiment, the exhaust partition wall 9*c* does not have a hollow structure. Cooling air having passed through the internal cavity in the partition wall 2*a* in the can body 2 is diverted by the lower half section 9*c*-L to flow to the areas in which the first and second auxiliary heat exchangers 11-1 and 11-2, respectively, are arranged. Thus, the auxiliary heat exchangers 11-1 and 11-2 can absorb heat in the cooling air heated when passing through the partition wall 2*a*. This improves heat efficiency.

Furthermore, in the second embodiment, the guide plate 9*b* has a vertical two-plate structure including an upper plate 9*b*-U fixed to the exhaust hood 9 and a lower plate 9*b*-L installed on the top surface of the can body 2. Inflow ports 10*a*-1 and 10*a*-2 are formed on the rear part in both the upper and lower plates 9*b*-U and 9*b*-L to allow the exhaust gases from the combustion sections 3-1 and 3-2 to flow into areas of the first and second exhaust spaces 10-1 and 10-2, respectively, located above the guide plate 9*b*. In the first embodiment, a gap is formed between a rear end of the guide plate 9*b* and a rear plate of the exhaust hood 9 so that the exhaust gases from the first and second combustion sections 3-1 and 3-2 flow into areas of the exhaust spaces 10-1 and 10-2, respectively, located above the guide plate 9*b* via the gap.

Furthermore, in the second embodiment, the heat absorbing tube fixing sections 9*f* are provided on the opposite surfaces of the exhaust partition wall 9*c*; the heat absorbing tube fixing sections 9*f* is made up of a clamp member that vertically sandwichingly holds all the laterally inward U turn sections 11*b* of the plurality of heat absorbing tubes (6 tubes) 11*a*, constituting the auxiliary heat exchangers 11-1 and 11-2. The heat absorbing tube fixing section 9*f* is provided on an inner surface of each of the side plates 9*e* of the exhaust hood 9; the heat absorbing tube fixing section 9*f* is made up of a clamp member that vertically sandwichingly holds all the laterally outward U turn sections 11*c* of the plurality of heat absorbing tubes 11*a*, constituting the auxiliary heat exchangers 11-1 and 11-2. Alternatively, a plate-like elastic member having an appropriate elasticity may be stuck to each of the exhaust partition wall 9*c* and the side plates 9*e*. Then, the U turn sections 11*b* and 11*c* of the heat absorbing tubes 11*a* may be fixed to the elastic members so as to cut into the elastic members. In this case, the elastic members correspond to the heat absorbing tube fixing sections.

The embodiments of the present invention have been described with reference to the drawings. However, the present invention is not limited to the embodiments. For example, in the above-described embodiments, each of the auxiliary heat exchangers 11-1 and 11-2 is composed of the plurality of heat absorbing tubes 11*a* each shaped to meander plural times in the lateral direction and having the laterally inward and outward U turn sections 11*b* and 11*c*. However, each of the heat absorbing tubes 11*a* may be separated, at a position corresponding to the laterally outward U turn section 11*c*, into two unit heat absorbing tubes, that is, a front unit heat absorbing tube and a rear unit heat absorbing tube, with the front and rear unit heat absorbing tubes connected together via a U bent on the outer surface of the target side plate 9*e*. However, the above-described embodiments are more advantageous because of the capabilities of efficiently recovering the latent heat from the exhaust gas flowing along the inner surface of the target side plate 9*e* and omitting the U bents to simplify the structure.

Furthermore, each of the auxiliary heat exchangers 11-1 and 11-2 may be composed of a plurality of heat absorbing tubes shaped to meander like the letter U and having only one laterally inward U turn section between the upstream end connected to the inflow header 11*d* and the downstream end connected to the outflow header 11*e*. Moreover, one heat absorbing tube may be formed to meander in a plurality of vertical steps so as to constitute each of the auxiliary heat exchangers 11-1 and 11-2. In this case, the water supply tube K1 and the connection tube K3 are connected directly to the upstream and downstream ends, respectively, of the heat absorbing tube in the first auxiliary heat exchanger 11-1, which ends penetrate the side plate 9*e* located outside the first exhaust space 10-1. The backward tube D1 and the connection tube D3 are connected directly to the upstream and downstream ends, respectively, of the heat absorbing tube in the second auxiliary heat exchanger 11-2, which ends penetrate the side plate 9*e* located outside the second exhaust space 10-2. Therefore, the inflow header 11*d* and the outflow header 11*e* are unwanted.

Furthermore, in the above-described embodiments, the second main heat exchanger 5-2 is the heating heat exchanger. However, the second main heat exchanger 5-2 may be used for additional bath heating to circulate water in the bathtub.

The invention claimed is:

1. A single can-type composite heat source machine comprising a single can body including a first combustion section having a first burner and a hot water supplying first main heat exchanger located above the first burner, and a second combustion section having a second burner and a second main heat exchanger located above the second burner and used for a purpose other than hot water supply, the first combustion section and the second combustion section being partitioned from each other by a partition wall and juxtaposed in a lateral direction, the machine comprising a first auxiliary heat exchanger of a latent heat recovery type connected to an upstream side of the first main heat exchanger and a second auxiliary heat exchanger of a latent heat recovery type connected to an upstream side of the second main heat exchanger, the machine being characterized in that:

a common exhaust hood straddling both the first and second combustion sections is located on a top surface of the can body, and a guide plate inclined so that a rear part of the guide plate is higher than a front part thereof is provided in a lower part of the exhaust hood to divert an exhaust gas to a rear part in the exhaust hood and then to guide the exhaust gas forward, and an exhaust partition wall is provided in the exhaust hood to partition a space in the exhaust hood into a first exhaust space through which an exhaust gas from the first burner having passed through the first main heat exchanger flows and a second exhaust space through which an exhaust gas from the second burner having passed through the second main heat exchanger flows;

the first auxiliary heat exchanger is located above the guide plate in the first exhaust space, and the second auxiliary heat exchanger is located above the guide plate in the second exhaust space; and each of the first and second auxiliary heat exchangers comprises a meandering heat absorbing tube having a laterally inward U turn section that turns around, without penetrating the exhaust partition wall, on a side of a surface of the exhaust partition wall located opposite a target side plate that is one of side plates provided on opposite lateral sides of the exhaust hood, the target side plate being positioned laterally outside an exhaust space in which each of the auxiliary heat exchanger is located, and the exhaust partition wall has a heat absorbing tube fixing section to which the laterally inward U turn sections of the heat absorbing tubes in each of the auxiliary heat exchangers are fixed.

2. The single can-type composite heat source machine according to claim 1, characterized in that the heat absorbing tube in each of the auxiliary heat exchangers has, in addition to the laterally inward U turn section, a laterally outward U turn section that turns around on the side of the target side plate without penetrating the target side plate.

3. The single can-type composite heat source machine according to claim 2, characterized in that the target side plate has a heat absorbing tube fixing section to which the laterally outward U turn sections of the heat absorbing tubes in each of the auxiliary heat exchangers are fixed.

4. The single can-type composite heat source machine according to claim 1, characterized in that the guide plate is formed to be continuous in the lateral direction across both the first and second exhaust spaces, and the exhaust partition wall is divided into two parts, an upper half section positioned above the guide plate and a lower half section positioned below the guide plate.

5. The single can-type composite heat source machine according to claim 1, characterized in that each of the main heat exchangers comprises a large number of heat absorbing fins stacked with front-back gaps created among the heat absorbing fins and a plurality of heat absorbing tubes extending long in the front-back direction so as to penetrate the heat absorbing fins, and the heat absorbing tubes are connected together via U bents each for two heat absorbing tubes on outer surfaces of plates arranged in a front and a rear of the can body so as to constitute continuous heat exchanging channels each extending from an upstream-end heat absorbing tube to a downstream-end heat absorbing tube, and the upstream-end heat absorbing tube and the downstream-end heat absorbing tube in each of the main heat exchangers are positioned laterally outward in the main heat exchanger, and upstream ends and downstream ends of the heat absorbing tubes in each of the auxiliary heat exchangers penetrate the target side plate.

* * * * *